United States Patent [19]

Iwasa et al.

[11] Patent Number: 4,600,675

[45] Date of Patent: Jul. 15, 1986

[54] MAGNETIC CARRIER FOR ELECTROSTATIC LATENT IMAGE DEVELOPMENT

[75] Inventors: Eiji Iwasa, Takarazuka; Noboru Ito, Amagasaki, both of Japan

[73] Assignee: Minolta Camera Kabushiki Kaisha, Osaka, Japan

[21] Appl. No.: 688,143

[22] Filed: Dec. 31, 1984

[30] Foreign Application Priority Data

Jan. 11, 1984 [JP] Japan ..... 59-4186

[51] Int. Cl.[4] ..... G03G 9/14

[52] U.S. Cl. ..... 430/106.6; 430/108

[58] Field of Search ..... 430/106.6, 108, 903

[56] References Cited

U.S. PATENT DOCUMENTS 3,558,492 1/1971 Proskow ..... 430/106.6 X
4,284,702 8/1981 Tabuchi et al. ..... 430/122

FOREIGN PATENT DOCUMENTS 55992 7/1982 European Pat. Off. ..... 430/106.6
2834309 2/1979 Fed. Rep. of Germany ..... 430/903
55-28020 2/1980 Japan ..... 430/106.6
58-179848 10/1983 Japan ..... 430/106.6

OTHER PUBLICATIONS

JII Journal of Technical Disclosure vol. 8-44 No. 83-11780 published Oct. 20, 1983, in Japan, (with translation) (Eiji IWASA "Magnetic Developer for Electrostatic Latent Image Development").

*Primary Examiner*—Roland E. Martin
*Attorney, Agent, or Firm*—Wenderoth, Lind & Ponack

[57] ABSTRACT

A magnetic carrier is disclosed which is for use in electrographic developing method which effects development of an electrostatic latent image with a magnetic developer at a developing region by rotating a developing sleeve incorporating a magnet therein thereby causing the aforementioned magnetic developer composed of an insulating toner and a magnetic carrier to be transported to the aforementioned developing region.

This magnetic carrier is composed preponderantly of fine magnetic powder and binder resin and is possessed of specific properties, i.e. 2000 to 3000 gasses of magentization in a magnetic field of 1000 oersteds, 60 to 250 oersteds of coercive force, and not less than $10^{12}\Omega$.cm of electric resistance.

1 Claim, 1 Drawing Figure

MAGNETIC CARRIER FOR ELECTROSTATIC LATENT IMAGE DEVELOPMENT

BACKGROUND OF THE INVENTION

1. Field of the Invention

This invention relates to a magnetic carrier for use in an electrographic developing method which effects development of an electrostatic latent image with a magnetic developer at a developing region by rotating a developing sleeve incorporating a magnet therein, thereby causing the aforementioned magnetic developer composed of an insulating toner and a magnetic carrier to be transported to the aforementioned developing region.

2. Description of the Prior Art

A developing method which comprises forming on the surface of a developing sleeve incorporating therein a magnet a magnetic brush of a magnetic developer composed of an insulating toner and a magnetic carrier, and making the magnetic brush come in rubbing contact with the surface of a carrier bearing an electrostatic latent image, thereby developing the electrostaic latent image formed on the surface of the aforementioned carrier to render the image visible. As a popular magnetic developer for the aforementioned developing method, the magnetic developer composed of a magnetic carrier of iron particles having an average particle diameter of 100 to 200 μm and an insulating toner of particles having an average particle diameter of 10 to 20 μm has been used. In this developer, however, the magnetic attraction exerted upon the carrier particles during the formation of a magnetic brush is so strong that the bristles of the magnetic brush are rigidified and the carrier particles are aggregated in the form of chains or fins on the developing sleeve, to induce occurrence of white streaks in solid developed images and other similar troubles. Further the electric resistance of the carrier itself is generally so small as to fall below $10^6$ Ω.cm. If the toner concentration in the developer is decreased as by continued use, therefore, the electric charge on the electrostatic latent image carrier escapes through the carrier to disturb the latent image and spoil the developed image. If, on the other hand, the carrier retains the electric charge injected from the developing sleeve, it undesirably adheres to the image portion of the electrostatic latent image carrier. Incidentally in the so-called toner image transfer type copier, if the carrier adheres to the surface of the electrostatic latent image carrier, the carrier particles which have high rigidity inflict scratches on the carrier surface while the carrier surface is cleaned as with a blade cleaner. The developer has another disadvantage that it produces no appreciable edge effect in a sense and, therefore, fails to reproduce fine line images with sufficient sharpness. These problems arising from the insufficient electric resistance offered by the carrier can be solved to some extent by coating the carrier particles with an insulating substance such as resin. In spite of this effort, the problem of the occurrence of white streaks in developed images due to the rigidity of bristles of the magnetic brush remains. Contrary to the insufficiency of the electric resistance, the electric charge generated by triboelectrification accumulates excessively in the carrier to affect the magnitude of triboelectrical charge of the toner and shorten the service life of the developer and, in the meantime, induce the problem of adhesion of carrier particles to the non-image portion of the electrostatic latent image carrier.

The so-called binder type carrier produced in an average particle diaemter of 5–30 μm by dispersing a fine magnetic powder in an insulating substance such as resin for the purpose of overcoming the drawbacks of the carrier formed of a simple magnetic substance as powdered iron has been proposed and put to actual use.

This binder type carrier has an advantage that since it is magnetized to a low level of about 1000 gausses in the magnetic field created at the developing region of the ordinary developing apparatus, it can form a magnetic brush of soft bristles and produce a developed image free from occurrence of white streaks. When a developer containing this binder type carrier is used in rapid development, a process introduced to meet the needs of the times, the developing sleeve suffers from heavy generation of heat and the developing apparatus necessitates use of a developing motor of high torque and the cost of equipment is high. Thus, the developing apparatus which uses the developer containing the aforementioned binder type carrier is generally desired to be of a type such that, by the rotation of the magnet incorporated within the developing sleeve, the bristles of a magnetic brush are rotated on the surface of the developing sleeve and the develper is transported to the developing region. When the magnet is rotated at a low rate, however, the low-frequency change of the magnetic field due to the rotation of the magnet is liable to result in uneven development and this uneven development tends to increase in proportion as the rate of development (the rate of movement of the electrostatic latent image) is increased. To prevent this uneven development, the rate of the rotation of the magnet must be increased as much as possible. Generally, in the aforementioned developing apparatus, the rate of the rotation of the magnet is set in the range of 1000 to 2500 rpm. In the case of the rapid development, the rate of the rotation must be increased proportionately to the rate of movement of the electrostatic latent image and, as an inevitable consequence, the eddy current generated within the developing sleeve is increased. As the rate of development is increased, the heat generated in the developing sleeve grows and the temperature of the developing sleeve rises and the load for rotation gains in magnitude and the torque of the motor used for rotating the magnet must be increased. Some of the electrographic systems available in the market adopt a developing apparatus of the type involving not only rapid rotation of the magnet but also supplemental rotation of the developing sleeve. Even the developing apparatus of this type is not free from the aforementioned problem which occurs during rapid development.

The method which uses a stationary magnet and requires only the developing sleeve to be rotated (hereinafter referred to as "developing sleeve rotation system") does not entail the problem ascribable to the rotation of the magnet. This fact may incite conception of an idea of precluding the occurrence of white streaks due to the aggregation of carrier particles and, at the same time, eliminating the drawbacks attendant upon the rotation of the magnet by using, in the developing sleeve rotation system, the developer containing the binder type carrier originally proposed for use in the magnet rotation system. Unfortunately, it has been experimentally ascertained that when the developer containing the binder type carrier famous for effective use in the magnet rotation system is simply diverted to the developing sleeve rotation system, the carrier adheres so heavily to the non-image portion of the surface of the electrostatic latent image carrier as to render the use of the developer infeasible. Thus, this idea has not yet been materialized.

SUMMARY OF THE INVENTION

A primary object of this invention is to provide a novel and convenient magnetic carrier for use in an electrographic developing method which effects development of an electrostatic latent image with a magnetic developer at a developing region by rotating a developing sleeve incorporating a magnet therein, thereby causing the aforementioned magnetic developer composed of an insulating toner and a magnetic carrier to be transported to the aforementioned developing region.

Another object of this invention is to provide a magnetic carrier which avoids being aggregated in the form of chains or fins on the developing sleeve and, therefore, permits formation of a magnetic brush of soft bristles and consequently ensures production of a developed image of high quality free from white streaks. Still another object of this invention is to provide a magnetic carrier which exhibits a proper edge effect and warrants production of a sharp developed image.

A further object of this invention is to provide a magnetic carrier which precludes excessive accumulation of electric charge generated by triboelectrification.

A still further object of this invention is to provide a magnetic carrier which is prevented from adhering to the surface of an electrostatic latent image carrier. A yet further object of this invention is to provide a magnetic carrier which is prevented from deterioration and consequently can contribute to lengthening the service life of the developer.

The aforementioned objects and other objects of this invention are attained by a magnetic carrier for use in an electrographic developing method which effects development of an electrostatic latent image with a magnetic developer at a developing region by rotating a developing sleeve incorporating a magnet therein, thereby causing the aforementioned magnetic developer composed of an insulating toner and a magnetic carrier to be transported to the aforementioned developing region, which magnetic carrier comprises a fine magnetic powder and a binder resin and possesses specific properties such as magnetization of 2000 to 3000 gausses in a magnetic field of 1000 oersteds, coercive force of 60 to 250 oersteds, and electric resistance of at least $10^{12}$ Ω.cm.

More specifically, the aforementioned magnetic carrier is intended for use in a developing method which effects transport of the magnetic developer to the developing region by mainly rotating the developing sleeve and either keeping the magnet stationary or supplementally rotating the magnet. The aforementioned magnetic carrier has a weight-average particle diameter of 35 to 100 μm.

Desirably, the amount of the fine magnetic powder contained in the magnetic carrier is in the range of 350 to 800 parts by weight based on the amount of the binder resin taken as 100 parts by weight. Further, the aforementioned fine magnetic powder is fine ferrite powder having electric resistance of at least $10^7$ Ω.cm. The aforementioned binder resin is a resin possessing a hydrophilic functional group. The amount of this functional group in the binder resin is in the range of 5 to 250 mg KOH/g as acid value or $OH^-$ value.

The other objects, advantages, and features of this invention will become apparent to those skilled in the art from the following description of a preferred embodiment of the invention, as illustrated in the accompanying drawing.

DETAILED DESCRIPTION OF THE INVENTION

Figure 1:
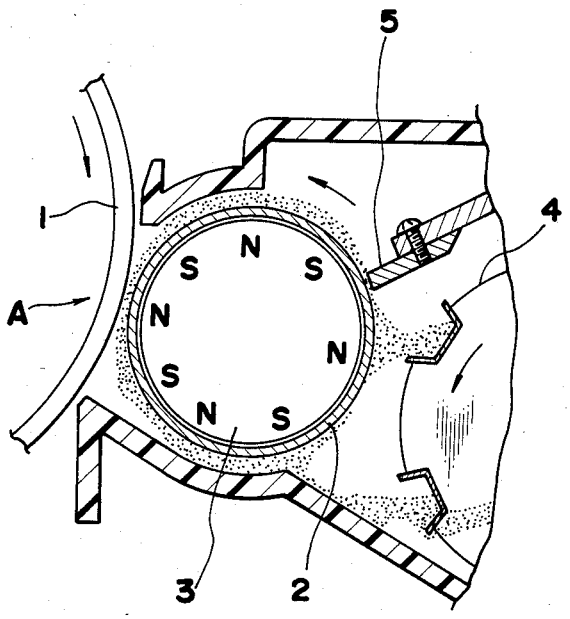
FIG. 1 is a schematic diagram illustrating a typical developing apparatus in which an electrostic latent image is developed by the use of a magnetic developer containing the magnetic carrier of the present invention.

The magnetic carrier to which this invention relates is a magnetic carrier intended for use in an electrographic developing method which effects development of an electrostatic latent image with a magnetic developer at a developing region by rotating a developing sleeve incorporating a magnet therein, thereby causing the aforementioned magnetic developer composed of an insulating toner and a magnetic carrier to be transported to the aforementioned developing region, which magnetic carrier comprises a fine magnetic powder and a binder resin and possesses specific properties such as magnetization of 2000 to 3000 gausses in a magnetic field of 1000 oersteds, coercive force of 60 to 250 oersteds, and electric resistance of at least $10^{12}$ Ω.cm.

Basically in the developing method of the developing sleeve rotation type, this invention defines the magnetization of the carrier in the magnetic field of 1000 oersteds to fall in the range of 2000 to 3000 gausses and the coercive force, Hc, of the carrier to fall in the range of 60 to 250 oersteds for the purpose of preventing the carrier particles from being aggregated and, at the same time, preventing the carrier particles charged by the frictional contact with the toner from adhering to the non-image portion of the surface of the electrostatic latent image carrier. The invention also defines the electric resistance of the carrier to be at least $10^{12}$ Ω.cm, as a condition correlated with the aforementioned conditions, for the purpose of ensuring production of a proper edge effect and, at the same time, precluding disturbance of latent image and preventing the carrier particles from adhering to the image portion of the surface of the electrostatic latent image carrier.

As concerns the electric resistance of the carrier, since the toner by nature is an insulating material, the electric resistance of the developer can be increased by increasing the toner concentration in the developer (the toner content of the developer) (generally not less than 5 wt%). Thus, a carrier having a slightly lower electric resistance of the order of $10^8$ to $10^{12}$ Ω.cm can be effectively used. This carrier, however, fails to produce a proper edge effect. Moreover, when the toner concentration of the developer is decreased by use, the amount of the carrier particles adhering to the surface of the electrostatic latent image carrier because of the occurrence of electric charge injection is inevitably increased. In this sense, the use of the carrier of such a lower electric resistance proves undesirable.

Preferably, for more thorough prevention of the aggregation of carrier particles and adhesion of carrier particles to the electrostatic latent image carrier, the average particle diameter of the carrier is defined to be in the range of 35 to 100 μm as weight-averaged particle diameter.

This invention defines the magnetic carrier to possess the specific properties mentioned above for the following reasons.

(1) If the magnetization in the magnetic field of 1000 oersteds is less than 2000 gausses, the adhesion of carrier particles to the non-image portion of the electrostatic latent image carrier occurs and the produced developed image suffers from fogging without reference to the magnitude of coercive force.

(2) If the coercive force is less than 60 oersteds, the carrier particles are aggregated on the developing sleeve and the produced developed image suffers from occurrence of white streaks as the aforementioned magnetization rises above 2000 gausses.

(3) If the coercive force exceeds 250 oersteds, the carrier particles even after separation from the developing sleeve retain the form of chains intact and exhibit poor compatability with the toner and, as the result, the developed image suffers from occurrence of fogging.

(4) While the coercive force is in the range of 60 to 250 oersteds, the same adverse phenomena as stated in (2) above take place as the aforementioned magnetization rises above 3000 gausses.

Thus, the use of the carrier possessing the aforementioned specific properties proves most advantageous.

The reason for the definition of the average particle diameter of the magnetic carrier in the range of 35 to 100 μm as weight-average particle diameter is that adhesion of the carrier particles to the electrostatic latent image carrier is liable to occur if the average particle diameter is less than 35 μm, and production of a clear developed image is not obtained if the average particle diameter exceeds 100 μm.

The magnetic carrier contemplated by this invention can be produced by dispersing a fine magnetic powder in an insulating binder resin. As the fine magnetic powder, fine ferrite powder having electric resistance of at least $10^7$ Ω.cm proves to be a good choice. As the binder resin, a resin possessing a hydrophilic functional group proves to be a wise choice. To be concrete, the ferrite material for the fine magnetic powder is a ferrite material represented by the general formula:

$$M_{\frac{1-x}{1+x}(1-y)}Fe_{\frac{2x}{1+x}(1-y)}O_y$$

(wherein M denotes at least one atom selected from the group consisting of Mn, Ni, Co, Mg, Cu, Zn, and Cd and x and y are numeric values satisfying $0.5 \leqq x \leqq 1$ and $0.1 \leqq y \leqq 0.571$).

Examples of the binder resin advantageously used herein include acrylic resins possessing such polar groups as acid group, carboxyl group, hydroxyl group, glycidyl group, and amino group, such as copolymer resin of a lower alkyl ester of acrylic acid and/or styrene with unsaturated acids such as methacrylic acid, acrylic acid, maleic acid, and itaconic acid; monomers possessing a hydroxyl group such as hydroxypolypropylene monomethacrylate and polyethylene glycol monomethacrylate; monomers possessing an amino group such as dimethylaminoethyl methacrylate; and/or glycidyl methacrylate. Further, polyester resins such as those produced by condensing polyols such as ethylene glycol, triethylene glycol, 1,2-propylene glycol, and 1,4-butane diol with dicarboxylic acids such as maleic acid, itaconic acid, and malonic acid and epoxy resins are other examples.

In the aforementioned magnetic carrier, the fine magnetic powder and the binder resin are generally mixed in a ratio of 350 to 800 parts by weight of the fine magnetic powder to 100 parts by weight of the binder resin. The reason for this specific range is that the carrier fails to exhibit sufficient magnetization in the aforementioned magnetic field if the proportion of the fine magnetic powder is less than 350 parts by weight, and the carrier itself becomes brittle if the proportion exceeds 800 parts by weight.

The optimum amount of the aforementioned functional group in the binder resin falls in the range of 5 to 250 mg KOH/g acid value or OH value. The reason for this specific range is that the resistance of the magnetic carrier to moisture is degraded and the magnitudes of electric resistance and electric charge of the carrier are lowered if the amount exceeds 250 mg KOH/g.

EXAMPLES

Now, the present invention will be described more specifically with reference to examples.

EXAMPLE 1

A mixture consisting of 100 parts by weight of styrene, 90 parts by weight of butyl methacrylate, 4 parts by weight of methacrylic acid, and 3.4 parts by weight of azo-bis-isobutyronitrile is dissolved in 200 parts by weight of xylene. The resultant solution is subjected to prepolymerization in a current of nitrogen at 100° C. for 20 minutes. The prepolymerization product is cooled to 70° C. and then left standing at this temperature for four hours for further polymerization. Consequently, there is obtained a copolymer resin having a number-average molecular weight (Mn) of 20000, a weight-average molecular weight (Mw) of 44000, and an acid value of 14 KOH/g. Then, the components indicated below are heated, kneaded, cooled, pulverized, and classified, to obtain a carrier, A, having an average particle diameter of 60 μm.

| (Carrier composition) | |
|---|---|
| Copolymer resin mentioned above | 100 parts by weight |
| Zn type ferrite (maximum magnetization - 72 emu/g, coercive force—force, Hc - 110, electric resistance - $3 \times 10^8$ Ω · cm, and average particle diameter - 0.6 μm) | 500 parts by weight |
| Carbon black (produced by Lion Akzo Co., Ltd. and marketed under trademark designation of Ketchen Black EC) | 2.0 parts by weight |
| Silica (produced by Aerozil Co., Ltd, and marketed under trademark designation of Aerozil #200) | 1.5 parts by weight |

Separately, copolymer resins having varying acid value of 5, 50, 100, and 200 mg KOH/g are prepared by varying the weight ratio of methacrylic acid in the aforementiond monomer composition. By using these copolymer resins in the aforementioned carrier composition, there are obtained carriers B, C, D, and E.

EXAMPLE 2

A mixture consisting of 100 parts by weight of styrene, 20 parts by weight of butyl methacrylate, 10 parts by weight of hydroxypolyethylene glycol (produced by Nippon Oils & Fats CO., Ltd. and marketed under trademark designation of Blemmer PE350), and 0.1 part by weight of benzoyl peroxide, is subjected to prepolymerization in a current of nitrogen gas at 100° C. for 20 minutes and then to polymerization in an autoclave at 85° to 95° C. under pressure of 40 kg/cm$^2$. Consequently, there is obtained a copolymer resin having a number-average molecular weight (Mn) of 6000, a weight-average molecular weight (Mw) of 15000, and an OH value of 21 mg KOH/g. Separately, copolymer resins having varying OH value of 5, 50, 100, and 170 mg KOH/g are obtained by varying the weight ratio of hydroxypolyethylene glycol in the aforementioned monomer composition.

By using these copolymer resins in the aforementioned carrier composition, carriers F, G, H, I, and J having an average particle diameter of 60 μm are obtained.

EXAMPLE 3

A reaction vessel provided with a stirrer and containing 700 parts by weight of polyoxypropylene-(2,2)-2,2-bis-(4-hydroxyphenyl)-propane and 97.2 parts by weight of terephthalic acid are placed in a mantle heater, heated to an elevated temperature under an atmosphere of nitrogen gas, and then caused to react by the addition of 0.05 g of dibutyl tin oxide. Further, 15.6 g of 1,2,4-benzene-carboxylic acid is added to the reaction vessel to participate in the reaction underway. Consequently, there is obtained a polyester resin having a softening point of 120° C., a glass transition point of 58° C., an acid value of 18 mgKOH/g and an OH value of 40 mgKOH/g. By using this resin in the aforementioned carrier compsotiion, a carrier, K, having an average particle diameter of 60 μm is obtained.

Further, by adding 2.5 parts by weight of oxidized polypropylene (acid value-19 mgKOH/g) to the composition of carrier K, there is obtained a carrier, L, having an average particle diameter of 60 μm.

COMPARATIVE EXPERIMENT 1

A carrier, M, having an average particle diameter of 60 μm is obtained by using nonpolar styrene-butadiene-methacrylate (Mn—10000 and Mw—28000, produced by Sanyo Chemical Industries Co., Ltd. and marketed under trademark designation of SMB 73) in the aforementioned carrier composition.

COMPARATIVE EXPERIMENT 2

A carrier, N, having an average particle diameter 60 μm is obtained by following the procedure of Example 1 for the preparation of Carrier A, except that a fine magnetic powder (coercive force, Hc—110 oersteds, maximum magnetization—62 emu/g, and electric resistance—$2\times10^7$ Ω.cm, produced by Toda Industries Ltd. and marketed under trademark designation of Magnetite EPT-1000) is used.

EXAMPLE 4

A carrier, O, having an average particle diameter of 60 μm is produced by using an epoxy resin (OH value—11 mgKOH/g, produced by Shell Chemical Co., Ltd, and marketed under trademark designation of Epikote 1007) in the aforementioned carrier composition.

EXAMPLE 5

A carrier, P, having an average particle diameter of 60 μm is produced by following the procedure of Example 1 for the preparation of Carrier A, except that the copolymer resin obtained in Example 1 and the nonpolar styrene-butyl-methacrylate (SBM 73) are mixed in a ratio of 1:1 and the resultant mixture is used in the same amount.

The various carriers so obtained are tested for electric resistance and magnetic properties. The results are shown in Table 1. It is noted from Table 1 that the resin's possession of a hydrophilic functional group is essential for the carrier to retain its electric resistance intact despite its combination with a large amount of fine magnetic powder. The decrease of the electric resistance is smallest when the resin possesses an acid group, followed by a hydroxyl group and a glycidyl group.

The electric resistance is determined by keeping a sample under a load of 285 g/cm$^2$, applying to the sample a voltage of 5000 V/cm, allowing the sample to stand at rest for 10 seconds after application of the voltage, and measuring the electric resistance. The magnetic properties are determined in a magnetic field of 1000 oersteds.

TABLE 1

| | Composition | | | | Electric | Magnetic properties | |
|---|---|---|---|---|---|---|---|
| No. | Fine magnetic powder | Resin | Acid value | OH value | resistance (Ω · cm) | Coercive force | Magnetization |
| A | Ferrite | Acid group-containing styrene acryl | 14 | — | $4\times10^{14}$ | 110 | 2300 |
| B | " | Acid group-containing styrene acryl | 5 | — | $5\times10^{12}$ | " | " |
| C | " | Acid group-containing styrene acryl | 50 | — | $6\times10^{14}$ | " | " |
| D | " | Acid group-containing styrene acryl | 100 | — | $3\times10^{14}$ | " | " |
| E | " | Acid group-containing styrene | 200 | — | $9\times10^{14}$ | " | " |

TABLE 1-continued

| No. | Composition: Fine magnetic powder | Composition: Resin | Composition: Acid value | Composition: OH value | Electric resistance (Ω · cm) | Magnetic properties: Coercive force | Magnetic properties: Magnetization |
|---|---|---|---|---|---|---|---|
| | | acryl | | | | | |
| F | " | Hydroxyl group-containing styrene acryl | — | 21 | $2 \times 10^{13}$ | " | " |
| G | " | Hydroxyl group-containing styrene acryl | — | 5 | $2 \times 10^{12}$ | " | " |
| H | " | Hydroxyl group-containing styrene acryl | — | 50 | $6 \times 10^{13}$ | " | " |
| I | " | Hydroxyl group-containing styrene acryl | — | 100 | $8 \times 10^{13}$ | " | " |
| J | " | Hydroxyl group-containing styrene acryl | — | 170 | $9 \times 10^{13}$ | " | " |
| K | " | Polyester | 18 | 40 | $6 \times 10^{14}$ | " | 2350 |
| L | " | Polyester + acid type wax | " | " | $7 \times 10^{14}$ | " | " |
| M | " | Styrene acryl | — | — | $7 \times 10^{9}$ | " | 2250 |
| N | Magnetite | Acid group-containing styrene acryl | 14 | — | $8 \times 10^{11}$ | 60 | 2000 |
| O | Ferrite | Epoxy | — | 11 | $6 \times 10^{12}$ | 110 | 2350 |
| P | " | Acid group-containing styrene acryl + styrene acryl | 7 | — | $2 \times 10^{14}$ | " | 2300 |

In Table 1, the low electric resistance exhibited by Carrier M may be logically explained by a postulate that because of the use styrene-acryl resin which lacks a hydrophilic functional group, the compatibility of the fine ferrite powder and the resin is inferior. The reason for the low electric resistance exhibited by Carrier N may be that fine magnetite powder is used as a fine magnetic powder instead of fine ferrite powder. The higher electric resistance in the carrier using fine ferrite powder may be possibly explained by a postulate that generally ferrite has higher electric resistance than magnetite, that ferrite enjoys better compatibility with a resin possessing a hydrophilic functional group, and that ferrite shows higher miscibility during the preparation of a carrier.

The aforementiond carriers are severally mixed with an insulating toner exhibiting a negatively charging property (electric resistance—at least $10^{15}$ Ω.cm and average particle diameter—12 μm) in a weight ratio of 100:5 to prepare two-component type magnetic developers. The developers are severally loaded in an electrographic copying machine provided with a developing apparatus illustrated in FIG. 1 and used to develop an electrostatic latent image formed on the surface of a photosensitive drum. The developed image is transferred onto a transfer paper. The images thus obtained in the transfer papers and the developed images formed on the photosensitive drum are visually examined.

The aforementioned developing apparatus is installed to confront with a photosensitive drum 1 coated with a selenium type photoconductive layer 50 μm in thickness and comprises a developing sleeve 2 rotatably disposed as separated by a minute opening from the surface of the photosensitive drum 1, an eight-pole magnetic roller 3 coaxially disposed fast within the developing sleeve, and a backet roller 4 adapted to stir the developer and cause triboelectrical charging between the toner and the carrier and supply the developer onto the surface of the developing sleeve 2. By the magnetic action of this magnetic roller 3, a magnetic brush of the developer is formed on the surface of the developing sleeve 2. By the rotation of the developing sleeve 2, the aforementioned developer is transported to the developing region A. The amount of the developer so transported is regulated by a control blade 5 to ensure supply of a proper amount of the developer to the developing region A. Consequently, the electrostatic latent image formed on the surface of the photosensitive drum 1 is developed by the developer. The magnetic brush which is formed at the developing region A is held in a state ready to rub the surface of the photosensitive drum.

The developed image on the surface of the photosensitive drum is transferred onto a transfer paper and then fixed thereon by the action of heat. The developing conditions adopted in the developing apparatus are as follows.

| (Developing contions) | |
|---|---|
| Peripheral speed of photosensitive drum: | 26 cm/second |
| Maximum potential of electrostatic latent image: | +650 V |
| Bias voltage for development: | +150 V |
| Diameter of developing sleeve: | 37 mm |
| Rotational speed of developing sleeve: (Peripheral speed of developing sleeve: 48 cm/second) | 250 rpm |

In the case of the developers containing Carriers A-L, O, and P according with the present invention, the surrounding areas of the line images fixed on transfer papers are perfectly free from adhesion of carrier or from fogging due to adhesion of toner, and the image portions are not found to suffer from adhesion of carrier, and the solid images are not found to contain any white streak. On the developing sleeve, absolutely no aggregation of the developer (carrier) is in sight. The images consequently obtained possess sharp boundaries owing to proper edge effect. Among carriers mentioned above, Carrier L is subjected to the aforementioned test for a fairly protracted period. Even after development of electrostatic latent images equivalent to 60000 sheets of transfer papers of A4 size, the carrier itself shows no sign of abnormal increase of electric charge (due to excessive accumulation of electric charge in carrier) and the amount of electric charge in the toner is stable constantly. These results establish that this carrier is capable of producing developed images of high quality free from fogging. The outstanding performance may be logically explained by a postulate that in spite of high electric resistance of the carrier, the fine magnetic powder existing in the surface of the carrier fulfils the function of properly leaking part of the electric charge of the carrier owing to the fact that the carrier is a binder type carrier.

In the case of the developers containing Carriers M, N of low magnitudes of electric resistance of Comparative Experiments 1 and 2, the images suffer from the drawbacks ascribable to the adhesion of carrier to the image portion of the photosensitive drum after decrease of the toner concentration in the developer. In the images, fine line images can not be reproduced satisfactorily.

EXAMPLE 6

Magnetic carriers having an average particle diameter of 40 μm (invariably having electric resistance above the level of $10^{12}$ Ω.cm) are produced by following the procedure of Example 1, except that the Zn type ferrite is used in a varying proportion indicated in Table 2 based on 100 parts by weight of the polyester resin of Example 3. The carriers are severally mixed with the same toner as used in the aforementioned example in a ratio of 100:5 to prepare magnetic developers. These developers are tested in the dveloping apparatus illustrated in FIG. 1 under the aforementioned conditions. The results are also shown in Table 2.

TABLE 2

| Amount of fine magnetic powder added (parts by weight based on 100 parts by weight of resin) | 200 | 300 | 400 | 500 | 600 | 900 |
|---|---|---|---|---|---|---|
| Magnetization (gauss) | 1310 | 1720 | 2100 | 2350 | 2550 | 3100 |
| Coercive force, Hc (oersted) | 110 | 110 | 110 | 110 | 110 | 110 |
| Aggregation of carrier particles on developing sleeve | No aggregation | No aggregation | No aggregation | No aggregation | No aggregation | Slight aggregation |
| Fogging due to adhesion of carrier to non-image portion of latent image | Fogging observed | Fogging observed | No fogging observed | No fogging observed | No fogging observed | — |

It is noted from Table 2 that magnetic carriers having coercive force of 110 oersteds and magnetization of 2000 to 3000 gausses neither induce aggregation of carrier particles on the developing sleeve nor entail fogging due to adhesion of carrier particles to the non-image portion of the latent image.

Separately, carriers of varied magnitudes of coercive force are prepared by using as fine magnetic powder products of Titan Industries Ltd. marketed under trademark designation of Magnetice BL-SP (coercive force—60 oersteds) and RB-BL (coercive force—200 oersteds) and a product of Toda Industries Ltd. marketed under trademark designation of Magnetite MTA-740 (coercive force—330 oersteds) in the place of the aforementioned Zn type ferrite. The developers containing these carriers are subjected to the same test as described above. It is confirmed that when the coercive force of the carrier exceeds 250 oersteds, the compatibility of the carrier and the toner degrades and the developed images consequently shows signs of fogging.

COMPARATIVE EXAMPLE 3

Several magnetic carriers having an average particle diameter of 40 μm and formed of varying simple magnetic substances indicated in Table 3 are prepared and subjected to the same test as indicated in Example 6. (These carriers are invariably coated with an insulating material to increase the magnitudes of electric resistance above $10^{12}$ Ω.cm) The results are shown in Table 3.

TABLE 3

| Kind of carrier | Ferrite particle A | Ferrite particle B | Ferrite particle C | Ferrite particle D | Magnetite particle A |
|---|---|---|---|---|---|
| Magnetization (gauss) | 1980 | 2100 | 3580 | 4300 | 4040 |

TABLE 3-continued

| Kind of carrier | Ferrite particle A | Ferrite particle B | Ferrite particle C | Ferrite particle D | Magnetite particle A |
|---|---|---|---|---|---|
| Coercive force, Hc (oersted) | ≈0 | ≈0 | ≈0 | ≈0 | ≈50 |
| Aggregation of carrier on developing sleeve | No aggregation | Aggregation | Aggregation | Aggregation | Slight aggregation |
| Fogging due to adhesion of carrier to non-image portion of latent image | Fogging observed | No fogging observed | No fogging observed | No fogging observed | No fogging observed |

It is noted from the results of Table 3 that so long as the magnetization in the magnetic field of 1000 oersteds is less than about 2000 gausses, no aggregation of carrier occurred even when the coercive force was less than 60 oersteds. However, fogging due to adhesion of carrier occurrs under such conditions. When the magnetization exceeded 2000 gausses, prominant white streaks occurr in the solid developed images because of aggregation of carrier, although no fogging ensues. The results establish that a carrier formed of a simple magnetic substance is not suited for use in the developing method of the developing sleeve rotation system.

It is evident from the comparison of Example 6 and Comparative Experiment 3 that the coercive force of the carrier must fall in the range of 60 to 250 oersteds. From the technical point of view, it is extremely difficult to produce a carrier possessing the coercive force in this specific range by using a simple magnetic substance. If such a carrier is obtained at all, it will prove to be prohibitively expensive. In the case of the so-called binder type carrier which is composed mainly of fine magnetic powder and binder resin, since the fine magnetic powder possesses an average particle diameter of not more than several μm, the carrier can be easily produced to acquire coercive force falling within the aforementioned specific range.

It is substantially safe to conclude that the magnetic carrier to which the present invention relates is producible only in the form of the aforementioned binder type carrier.

It is generally held that the coercive force of the carrier, as viewed purely from the standpoint of the miscibility with the toner, is desired to be as low as permissible and that the reduction of the coercive force discourages the occurrence of fogging. As is evident from the test results given above, however, the magnetic carrier of this invention provides advantageous development even when the coercive force falls in the range of 60 to 250 oersteds.

Obviously, many modifications and variations of the present invention are possible in light of the foregoing teachings. It is therefore to be understood that within the scope of the appended claims, the present invention may be practiced otherwise than as specifically described herein.

What is claimed is:

1. A magnetic carrier suitable for use in an electrographic developing method which effects development of an electrostatic latent image with a magnetic developer at a developing region by rotating a developing sleeve incorporating a magnet therein, thereby causing said magnetic developer, composed of an insulating toner and a magnetic carrier, to be transported to said developing region, said magnetic carrier having a weight-average particle diameter of 35 to 100 μm and comprising 350 to 800 parts by weight of a fine ferrite powder having an electric resistance of at least $10^7$ Ω.cm, and 100 parts by weight of a binder resin having a hydrophilic functional group in an amount such that the acid value or OH value of the binder resin is in the range of 5 to 250 mg KOH/g, said magnetic carrier possessing the following properties: (1) magnetization of 2000 to 3000 gausses in a magnetic field of 1000 oersteds, (2) coercive force of 60 to 250 oersteds, and (3) electric resistance of at least $10^{12}$ Ω.cm.

* * * * *